United States Patent [19]

Griefahn

[11] 3,947,067

[45] Mar. 30, 1976

[54] CHAIR

[75] Inventor: Hans-Joachim Griefahn, Wetter, Germany

[73] Assignee: Stanzwerk Peitz & Co., Wetter, Germany

[22] Filed: Nov. 5, 1973

[21] Appl. No.: 412,796

[52] U.S. Cl. ..... 297/84; 297/316

[51] Int. Cl.[2] ..... A47C 1/035

[58] Field of Search ..... 297/84, 85, 316, 320, 321

[56] References Cited

UNITED STATES PATENTS

| | | | |
|---|---|---|---|
| 2,859,799 | 11/1958 | Moore | 297/316 X |
| 2,994,363 | 8/1961 | Fox | 297/85 X |
| 3,086,814 | 4/1963 | Fletcher | 297/84 |
| 3,094,353 | 6/1963 | Mizelle | 297/85 |
| 3,269,769 | 8/1966 | Mizelle | 297/85 |
| 3,300,243 | 1/1967 | Mizelle | 297/85 |
| 3,322,459 | 5/1967 | Hampton | 297/85 |

FOREIGN PATENTS OR APPLICATIONS

| | | | |
|---|---|---|---|
| 1,294,616 | 9/1969 | Germany | 297/85 |

*Primary Examiner*—Francis K. Zugel
*Attorney, Agent, or Firm*—Spencer & Kaye

[57] ABSTRACT

An adjustable easy chair with variable seat inclination and variable seat angle. The chair has a frame, a seat and a back, and a multiple-element linkage mounted to the frame on both sides of the seat and back. Each linkage has two rockers which extend downwardly from a first coupling member supporting the seat of the chair. The lower end portions of the rockers are articulated to a second coupling member which is oriented in approximately the same direction as the first coupling member. The rearward end portion of the second coupling member is articulated to the lower end portion of the rocker mounted to the frame and supporting the back, and the front end portion of the seat is articulated indirectly to the frame of the chair. The linkage is a four-element linkage having two rockers of unequal lengths, the front end portion of the first coupling member being supported on the frame by the four-element linkage. The point of connection of the first coupling member at the linkage is in the region of the point of connection of the longer of the rockers, and there is abutment means for limiting the pivot angle of the rockers at least in the rearward direction.

7 Claims, 6 Drawing Figures

CHAIR

BACKGROUND OF THE INVENTION

The present invention relates to an adjustable easy chair with variable seat inclination and variable seat angle, of the type which is provided on both sides of the seat and back with a multi-element linkage fastened to the frame of the chair, the linkages having two rockers extending downwardly from a coupling member supporting the seat of the chair. The lower end portions of the rockers are articulated to a second coupling member oriented in approximately the same direction as the first coupling member and the rear end portion of the second coupling member is articulated to the lower end portion of the rocker which is mounted in permanent connection with the frame of the chair and supports the back of the chair. The front end portion of the seat is indirectly articulated to the chair frame.

Aside from such known adjustable chairs in which a change of the seat inclination and/or the seat angle causes the seat to travel relatively far forward or backward with respect to the frame, there exist adjustable chairs in which this drawback is almost completely eliminated.

In such chairs, which also permit the use of so-called hammer-head cushions, a multi-element linkage is suspended on both sides of the seat and the back of the chair. Each one of these linkages has two downwardly directed rockers which are articulated to the frame and are connected by means of a coupling member to form a four-element linkage, the back of the chair being fastened to the rearward rocker. The rearward rocker is additionally provided with a forwardly directed lever. Moreover, two further upwardly directed rockers are articulated to the coupling member and are coupled together through the seat. Furthermore, a control element engages the rear of the rocker which engages at the seat, this control element being cam activated.

This known adjustable chair, however, has the drawback, inter alia, that the cam-type control element is relatively complicated, expensive and requires maintenance.

Moreover, the various preselectable positions of the adjustable chair are badly marked. This also applies to such footrests as may be provided, which automatically pivot out under the influence of the seat or back when the seat and/or the back positions are varied.

SUMMARY OF THE INVENTION

It is, therefore, the object of the present invention to provide an easy chair which overcomes the above drawbacks, and to simplify the control and eliminate the need for maintenance as well as to provide possibilities for better securing the preselectable seat, back and footrest positions than heretofore possible.

According to the present invention, this is accomplished by providing an adjustable easy chair wherein the front end portion of the first coupling member is supported at the frame via a four-element linkage having rockers of unequal length, the point of connection of the first coupling member at the linkage being disposed in the area of the point of connection of the longer of the two rockers, there being an abutment which limits at least the rearward position of the rockers.

This has the advantage that no complicated cam controlled devices are required.

Moreover, the easy chair according to the present invention can readily be placed into the so-called "television position", although this position can be overcome by a displacement of weight of the person in the chair.

Furthermore, even though the angle of the seat is increased, a foot rest can be brought into position by shifting the weight of the person.

According to one embodiment of the invention, the long rocker of the linkage at the front edge of the seat is adjacent the short rocker at the rear edge of the seat. Preferably, the coupling member for the four elements is articulated to the first coupling member ahead of the point of connection of the long rocker of the linkage.

According to another feature of the present invention, the coupling member for the linkage extends, approximately by its length between the connection points of the linkage, beyond the point of connection of the long rocker and is articulated at its free end to the front end portion of the first coupling member.

According to yet another feature, the coupling member for the linkage is, between the points of connection of the rockers, shorter than the long rocker of the linkage and longer than the short rocker. Preferably, the distance between the points of connection for the rockers of the linkage of the frame is greater than the distance between their points of connection with their coupling member.

According to another embodiment of the invention, a pull member is provided which limits the seat angle. One end portion of this pull member is mounted to the rocker supporting the back of the chair and the other end portion is mounted at the rear rocker which connects the first and the second coupling members.

DESCRIPTION OF THE PREFERRED EMBODIMENTS

Figure 1:
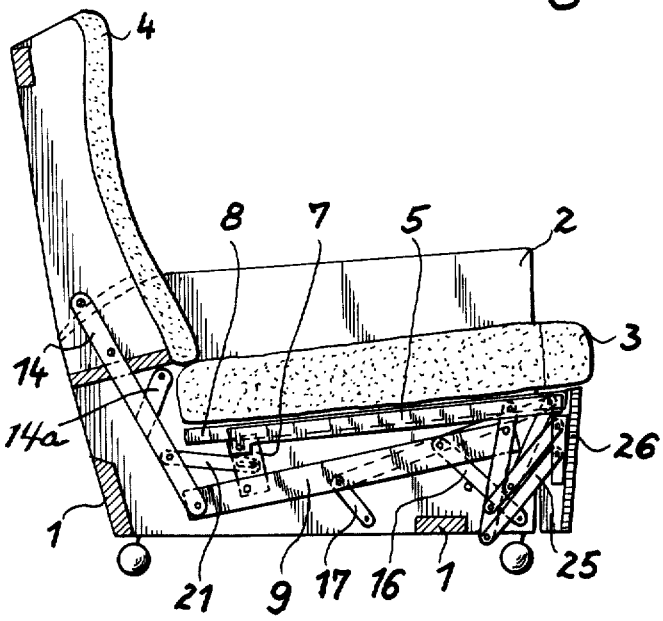
FIG. 1 is a longitudinal sectional view of an adjustable chair in the sitting position.
Figure 2:
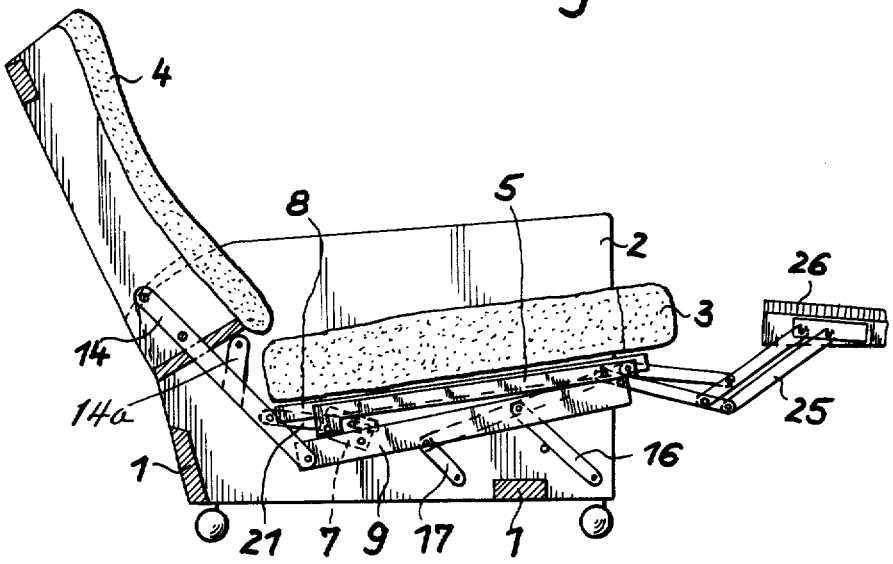
FIG. 2 is a longitudinal sectional view of the same chair in the so-called "television position" with extended foot rest.
Figure 3:
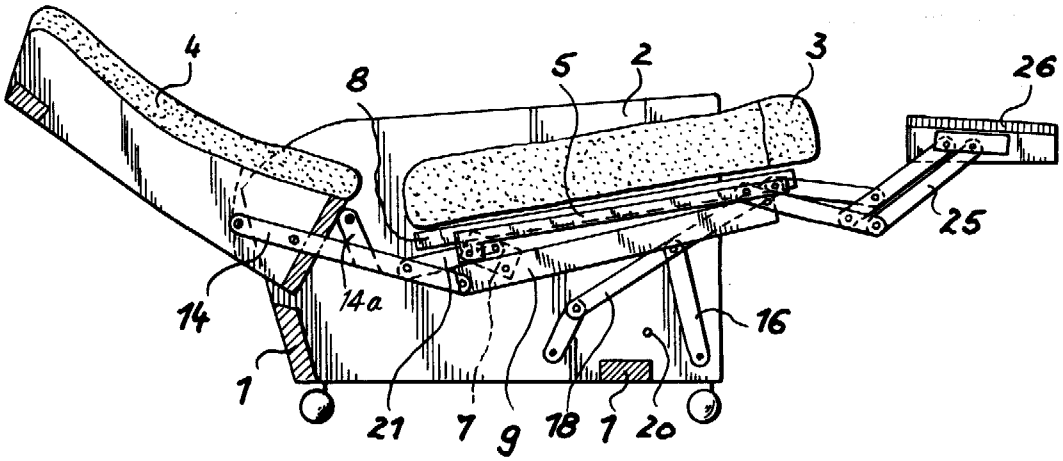
FIG. 3 is a longitudinal sectional view of the same chair in the reclined position.
Figure 4:
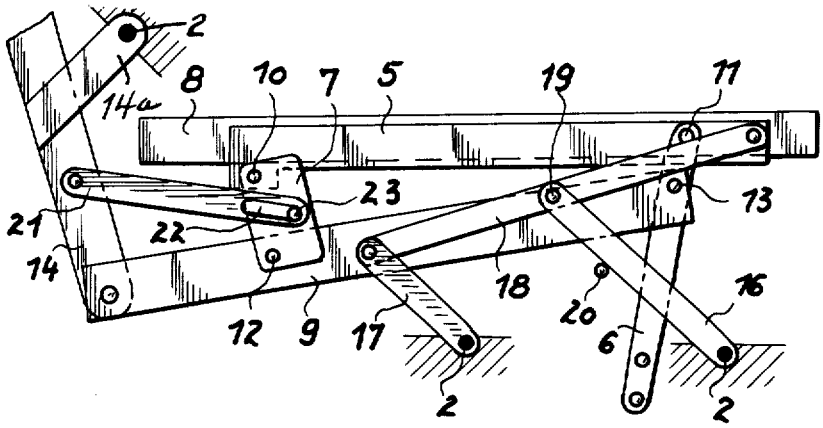
FIGS. 4 to 6 are enlarged side elevational views of the parts corresponding to the chair positions shown in FIGS. 1 to 3.
Figure 5:
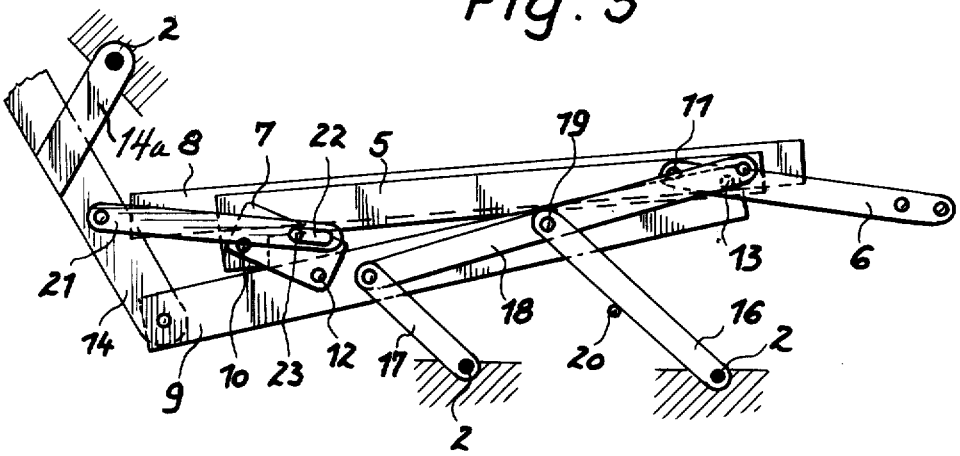

An adjusting mechanism incorporating a multiple element linkage is provided at both sides of the seat 3 and the back 4 at the two side wings 2 of the frame which are permanently connected together by frame portions 1. Each one of the two linkages includes two rockers 6 and 7 which are directed downwardly from a coupling member 5. The coupling members 5 for both linkages are bridged by a carrier 8 on which rests the seat 3.

The lower end portions of rockers 6 and 7 are articulated to a second coupling member 9, the distance of the points of connection 10, 11 from one another being greater than the distance between the points of connection 12, 13. The rocker 7 is longer than the rocker 6.

The rearward end portion of the coupling member 9 which protrudes rearwardly beyond the point of connection 12 is articulated to a rocker 14 which is articulated to frame 2 by a connecting member 14a. The back of the chair 4 is fastened between rockers 14 of the two linkages.

The seat 3 is supported, in the region of the front edge and at both sides, by a four-element linkage which engages at coupling member 5 in front of rocker 6. Each one of these linkages includes a long and a short rocker 16, 17 whose lower end portions are articulated to frame 2.

A coupling member 18 is articulated to the upper end portions of rockers 16, 17. The coupling member 18 extends beyond the point of connection 19 and is articulated to the coupling member 5.

A pin-type abutment 20 also protrudes from frame 2 in order to rearwardly limit the pivot angle of rocker 16.

The seat angle is limited by a pull member 21 in the form of a flat rod which is articulated to rocker 14 and which is provided at its free end with a longitudinal hole 22 which extends in the longitudinal direction and acts as the pull member. A pin 23 which extends from rocker 7 coacts with the pull member.

Figure 6:
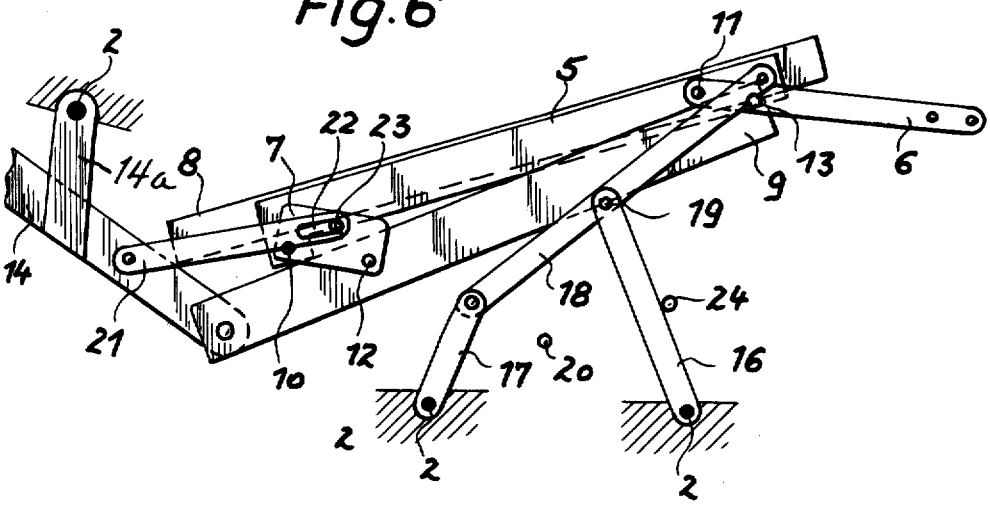

In addition to or instead of this pull member 21, there is provided a second abutment 24 which limits the forward swing of the rocker 16. This abutment, which is on the frame 2, becomes operative in the reclined position of the chair (FIG. 6).

The rocker 6 extends beyond its point of connection 13 and at its free end carries the adjusting members 25 for a foot rest 26.

It will be understood that the above description of the present invention is susceptible to various modifications, changes and adaptations and the same are intended to be comprehended within the meaning and range of equivalents of the appended claims.

I claim:

1. In an adjustable easy chair with variable seat inclination and variable seat angle, the chair having a frame, a seat and a backrest; a mechanism interconnecting the frame, the seat and the backrest and including, on both sides of the seat, a first coupling member extending forwardly from the backrest and supporting the seat of the chair and having rear and front portions; first and second rockers pivotally attached to the first coupling member adjacent the rear and the front portions thereof, respectively; the first and second rockers extending downwardly from the first coupling member; a second coupling member disposed below and extending generally in the same direction as the first coupling member and having a rear and a front portion; the first and second rockers being articulated to the second coupling member adjacent its rear and front portions, respectively; a third rocker on which the backrest is supported having a lower end portion at which it is pivoted to the rear portion of the second coupling member; the improvement in said mechanism, comprising in combination:

a. connecting means for articulating said third rocker to said frame, said connecting means being attached to said third rocker at a distance from the articulation between said third rocker and said second coupling member;

b. a third coupling member articulated to said front portion of said first coupling member;

c. a fourth rocker articulated to said third coupling member and to said frame;

d. a fifth rocker articulated to said third coupling member between the articulation of said third coupling member to said fourth rocker and to said first coupling member, said fifth rocker further being articulated to said frame and being longer than said fourth rocker; and e. abutment means for limiting the pivot angle of said fourth and fifth rockers at least in the rearward direction;

whereby said first coupling member, together with said seat of the chair executes no rearward motion when said third rocker, together with said backrest is moved from a substantially upright, sitting position into a more inclined, television position.

2. Adjustable easy chair as defined in claim 1, wherein said fifth rocker is adjacent the front edge of said seat and said fourth rocker is adjacent the rear edge of said seat.

3. Adjustable easy chair as defined in claim 1, said third coupling member being articulated to said first coupling member ahead of the point of connection of said fifth rocker.

4. Adjustable easy chair as defined in claim 1, wherein said third coupling member being, between its points of connection with said fourth and fifth rockers, shorter than said fifth rocker and longer than said fourth rocker.

5. Adjustable easy chair as defined in claim 1, wherein the distance between the points of connection at said frame for said fourth and fifth rockers is greater than the distance between their points of connection at said third coupling member.

6. Adjustable easy chair as defined in claim 1, further comprising a pull member for limiting the seat angle, one end portion of said pull member being mounted at said third rocker and the other end portion being mounted at said first rocker.

7. Adjustable easy chair as defined in claim 1, wherein the distance between the articulations of said third coupling member to said fourth and fifth rockers approximately equals the distance between the articulations of said third coupling member to said fifth rocker and said first coupling member; said third coupling member extending in the forward direction from said fourth rocker to the articulation with said first coupling member.

* * * * *